US009591893B2

(12) United States Patent
West et al.

(10) Patent No.: US 9,591,893 B2
(45) Date of Patent: Mar. 14, 2017

(54) FASTENER WITH CONCEALED TOOL BITS

(71) Applicant: WESTLIFE DESIGN GROUP, LLC, Gardena, CA (US)

(72) Inventors: Michael Akira West, Manhattan Beach, CA (US); Michael Bretz, Redondo Beach, CA (US)

(73) Assignee: Westlife Distribution USA, LLC, Gardena, CA (US)

( * ) Notice: Subject to any disclaimer, the term of this patent is extended or adjusted under 35 U.S.C. 154(b) by 0 days.

(21) Appl. No.: 14/573,766

(22) Filed: Dec. 17, 2014

(65) Prior Publication Data

US 2016/0174664 A1 Jun. 23, 2016

(51) Int. Cl.

| | |
|---|---|
| ***A44B 11/00*** | (2006.01) |
| ***A44B 11/04*** | (2006.01) |
| ***A41F 9/00*** | (2006.01) |
| ***A45F 3/14*** | (2006.01) |
| ***A45F 5/02*** | (2006.01) |
| ***B25H 3/00*** | (2006.01) |
| *A44B 11/24* | (2006.01) |

(52) U.S. Cl.

CPC ..... *A44B 11/005* (2013.01); *A41F 9/002* (2013.01); *A44B 11/006* (2013.01); *A44B 11/04* (2013.01); *A45F 3/14* (2013.01); *A45F 5/021* (2013.01); *B25H 3/003* (2013.01); *A44B 11/24* (2013.01); *A45F 2200/0575* (2013.01)

(58) Field of Classification Search

CPC ..... A44B 11/005; A44B 11/006; A44B 11/04; A44B 11/02; A41F 9/002; A41F 9/02; Y10T 24/4098

USPC ..... 2/300

See application file for complete search history.

(56) References Cited

U.S. PATENT DOCUMENTS 2,827,214 A * 3/1958 Lutz ..... A41F 9/002 224/249
4,905,878 A * 3/1990 Lovinger ..... A44B 11/005 224/163

(Continued)

FOREIGN PATENT DOCUMENTS

CN 202112440 1/2012
CN 202127918 2/2012

(Continued)

*Primary Examiner* — Anna Kinsaul
*Assistant Examiner* — Heather Mangine
(74) *Attorney, Agent, or Firm* — Stetina Brunda Garred & Brucker

(57) ABSTRACT

A multifunctional belt comprising an elongate belt strap having an end flap segment selectively transitional relative to a body segment between a looped configuration and an extended configuration. A fastener is coupled to the belt strap for securing the end flap segment in the looped configuration. A buckle is coupled to the belt strap and includes a buckle frame, a cross bar, and at least one tool bit. The buckle frame defines a longitudinal frame axis, and the cross bar extends between opposed portions of the buckle frame and defines cross bar axis that is generally perpendicular to the longitudinal frame axis. The tool bit is pivotally coupled to the cross bar and is pivotable about the cross bar axis. The tool bit is sized and positioned to be captured between the end flap segment and the body segment when the end flap segment is in the looped configuration.

8 Claims, 4 Drawing Sheets

(56) References Cited

U.S. PATENT DOCUMENTS

| | | | | |
|---|---|---|---|---|
| 5,123,579 | A | 6/1992 | Sugiyama | |
| 5,217,150 | A | 6/1993 | Chen | |
| 5,609,281 | A * | 3/1997 | West | A44B 11/005 224/163 |
| 6,137,672 | A | 10/2000 | Mizuno et al. | |
| 2003/0135913 | A1* | 7/2003 | Yang | A41F 9/02 2/338 |
| 2007/0284405 | A1 | 12/2007 | Prevost | |
| 2013/0189631 | A1 | 7/2013 | Mojica | |

FOREIGN PATENT DOCUMENTS

| | | | | |
|---|---|---|---|---|
| CN | 203109915 | | 8/2013 | |
| GB | 966255 A | * | 8/1964 | A44B 11/02 |

* cited by examiner

FASTENER WITH CONCEALED TOOL BITS

CROSS-REFERENCE TO RELATED APPLICATIONS

Not Applicable

STATEMENT RE: FEDERALLY SPONSORED RESEARCH/DEVELOPMENT

Not Applicable

BACKGROUND OF THE INVENTION

1. Field of the Invention

The present invention relates generally to a belt, and more specifically, to a belt having integrated tool bits which are concealed by the belt strap when the belt is worn by a user.

2. Description of the Related Art

Belts have been worn for many years because of the various functional and aesthetic benefits associated therewith. For instance, a belt may function to support pants, shorts, or other articles of clothing on a wearer. Belts may also be fabricated in a wide range of materials and colors so as to complement the overall aesthetic appearance of the wearer's clothing.

In view of the overall utility and aesthetic appeal associated with belts, individuals wear belts on a wide range of occasions. In this respect, belts are not only worn during formal occasions to compliment one's suit or tuxedo, belts are also worn during sporting activities. Indeed, most baseball and football teams include a belt as part of the team uniform. Furthermore, it is also common for those participating in snowboarding, skateboarding and other extreme sports to wear a belt.

Belts have also been recognized as a mechanism by which one can carry tools or other utility items. For instance, tool belts are oftentimes worn by construction worker to hold tools which may be needed quickly. In this respect, when the tools are stowed within a tool belt, the tools travel with the wearer, without requiring the wearer to manually carry the tools. A gun holster is another example of an accessory that may be supported by a belt to allow a wearer to carry a gun or other weapon without using the wearer's hands. Yet another accessory that has been commonly carried on one's belt is a smartphone. A smartphone holster may be connected to a belt and the wearer may stow the smartphone in the smartphone holster to enable effortless carrying of the smartphone, as well as quick and easy access thereto. In this respect, a belt does not only provide utility in relation to supporting one's clothes; rather, a belt may also be useful for supporting one or more tools or other accessories thereon.

One particular drawback to using a belt as means for supporting tool or other accessories is that the supported items typically hang from the belt or remain external to the belt. This may be particularly problematic in sporting environments, where the externally located item may present a safety hazard, or may alter the appearance of the wearer. This may be particularly true in sports such as snowboarding or skateboarding, where one's appearance Accordingly, there is a need in the art for an improved belt design which allows tools to be worn in a concealed manner. Various aspects of the present invention address this particular need, as will be discussed in more detail below.

BRIEF SUMMARY OF THE INVENTION

In accordance with one embodiment of the present invention, there is provided a multifunctional belt including a buckle having one or more tool bits pivotally coupled thereto. The belt is specifically adapted to conceal the tool bits by covering the tool bits with the belt strap when the belt is worn by the user. The tool bits may be accessed by unfastening the belt strap. Thus, the multifunctional belt allows the user to easily carry tools for easy access when such tools may be needed.

A multifunctional belt comprising an elongate belt strap extending along a longitudinal strap axis. The belt strap includes an end flap segment and a body segment. The end flap segment is selectively transitional relative to the body segment between a looped configuration and an extended configuration. The end flap segment is folded back towards the body segment to overlap a portion of the body segment as the end flap segment transitions from the extended configuration towards the looped configuration. A fastener is coupled to the belt strap and is configured to detachably secure the end flap segment in the looped configuration. A buckle is coupled to the belt strap and includes a buckle frame, a cross bar, and at least one tool. The buckle frame defines a longitudinal frame axis, and the cross bar extends between opposed portions of the buckle frame and defines cross bar axis that is generally perpendicular to the longitudinal frame axis. The at least one tool bit is pivotally coupled to the cross bar and is pivotable about the cross bar axis. The at least one tool bit is sized and positioned to be captured between the end flap segment and the body segment when the end flap segment is in the looped configuration, and uncovered by the end flap segment as the end flap segment transitions from the looped configuration towards the extended configuration.

The buckle may be slidable along the belt strap when the belt strap is in the extended configuration. The buckle may also be removable from the belt strap when the belt strap is in the extended configuration.

The at least one tool bit may include a plurality of tool bits including at least two of a Philips head screwdriver bit, a flat-head screwdriver bit, and an Allen-wrench bit.

The fastener may include complimentary fastener bodies which are engaged with each other when the belt strap is in the looped configuration and disengaged with each other when the belt strap is in the extended configuration. The fastener bodies may include complimentary snap fastener bodies.

The belt strap may be formed of a woven nylon material.

According to another embodiment, there is provided a multifunctional belt including a buckle having a buckle frame, a cross bar, and at least one tool bit. The belt includes a belt strap including a buckle end portion and an opposed distal end portion, with the belt strap being coupled to the buckle at the buckle end portion. The belt strap further includes an inner surface and an opposed outer surface. The belt strap is selectively disposable in an open configuration wherein the distal end portion is disengaged from the buckle and a closed configuration wherein the distal end portion is engaged with the buckle. The inner surface faces the wearer when the belt is in the closed configuration and is positioned between the at least one tool bit and the outer surface when the belt strap is in the closed configuration to conceal the at least one tool bit.

The present invention will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION OF THE INVENTION

The detailed description set forth below in connection with the appended drawings is intended as a description of certain embodiments of a multifunctional belt and is not intended to represent the only forms that may be developed or utilized. The description sets forth the various structure and/or functions in connection with the illustrated embodiments, but it is to be understood, however, that the same or equivalent structure and/or functions may be accomplished by different embodiments that are also intended to be encompassed within the scope of the present disclosure. It is further understood that the use of relational terms such as first and second, and the like are used solely to distinguish one entity from another without necessarily requiring or implying any actual such relationship or order between such entities.

Figure 2:
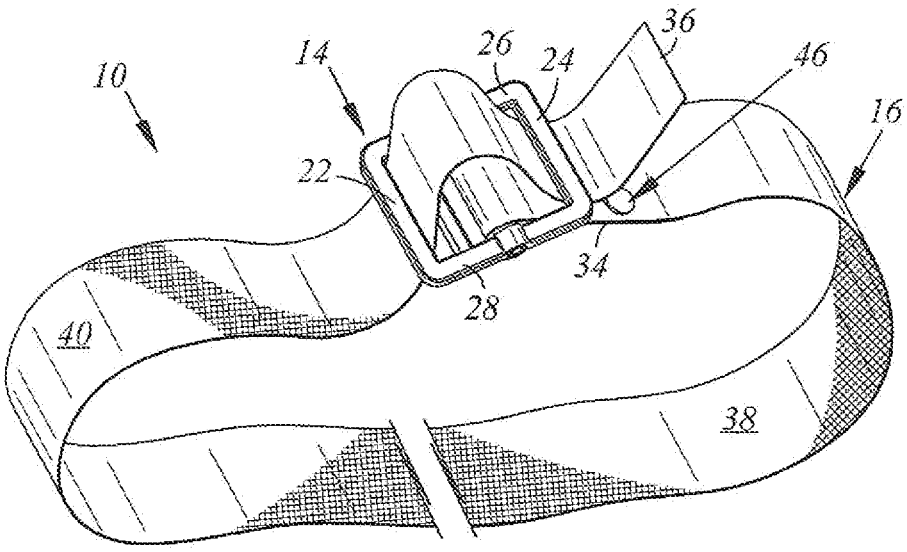
FIG. 2 is an upper perspective view of both ends of the belt strap coupled to the fastener to allow the belt strap to assume a closed configuration to define a loop.

Referring now to the drawings, wherein the showings are for purposes of illustrating a preferred embodiment of the present invention, and not for purposes of limiting the same, there is depicted a multi-functional belt 10 (see FIG. 2) having one or more tool bits 12 integrated into the buckle 14. Various aspects of the present invention are directed toward configuring the belt buckle 14 and corresponding belt strap 16 to allow the tool bits 12 to be concealed by the belt strap 16 when the belt 10 is worn in a conventional manner by a wearer, e.g., when the belt 10 is fastened to the wearer. When the tool bits 12 are needed, the belt strap 16 may be unfastened to uncover the tool bits 12. Thus, the belt 10 allows the tool bits 12 to be worn by the wearer while participating in sports related activities, such as snowboarding, skateboarding, or the like, to enable immediate access to the tool bits 12 when they are needed, as may be required to adjust a snowboard binding or a skateboard truck.

The belt buckle 14 includes a buckle frame 18 defining a buckle plane 15, a longitudinal frame axis 17, and a buckle opening 20. In the exemplary embodiment, the buckle frame 18 is quadrangular in shape and defines a first pair of opposed frame members 22, 24 and a second pair of opposed frame members 26, 28. The first pair of opposed frame members 22, 24 extend generally perpendicular to the longitudinal frame axis 17, while the second pair of opposed frame members 26, 28 extend generally parallel to the longitudinal frame axis 17. In the exemplary embodiment, the frame members 22, 24, 26, 28 collectively circumnavigate the buckle opening 20, although it is understood that in other embodiments, the buckle frame 18 may not completely circumnavigate the buckle opening 20. Furthermore, although the exemplary buckle frame 18 is quadrangular in shape, it is also contemplated that other buckle frames 18 may define other shapes, such as circular, oval, triangular, hexagonal, or other shapes and configurations known by those skilled in the art. The buckle frame 18 is preferably formed from a metallic material, although other materials known in the art may also be used. The buckle 14 may also include one or more strap guide bar(s) 25 for guiding a belt strap 16 through buckle 14, as will be described in more detail below.

The buckle 14 further includes a cross bar 30 coupled to the buckle frame 18 and defining a cross bar axis 32 that is generally perpendicular to the longitudinal frame axis 17. The cross bar 30 is sized and configured to extend between opposed portions of the buckle frame 18. In the exemplary embodiment, the cross bar 30 is coupled to, and extends between, opposed frame members 26, 28. The cross bar 30 may be detachable from the buckle frame 18 to allow a user to swap out tool bits 12. In one embodiment, the cross bar 30 is coupled to the buckle frame 18 via threaded engagement. As such, the cross bar 30 may include a head portion adapted to engage with a screw driver, Allen-wrench or other tool for tightening or loosening the cross bar 30 relative to the buckle frame 18.

Figure 1:
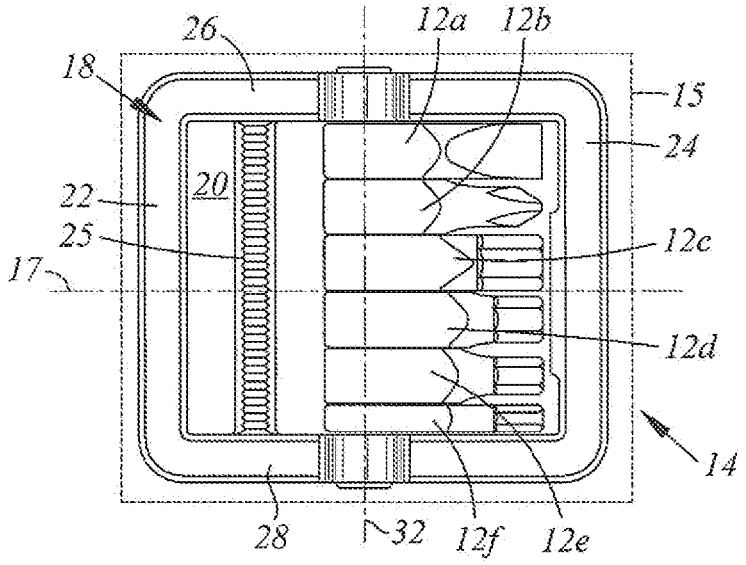
FIG. 1 is a top view of a strap fastener having integrated tool bits.
Figure 3:
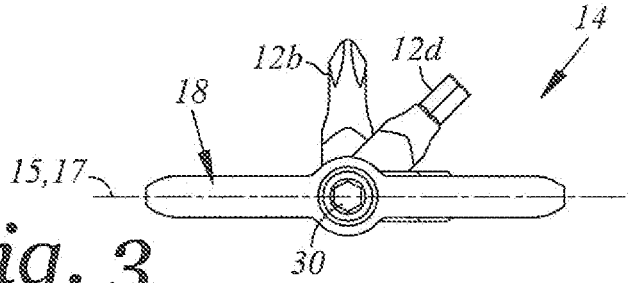
FIG. 3 is a side view of the fastener depicted in FIG. 1, with the tool bits shown in varying degrees of deployment.
Figure 4:
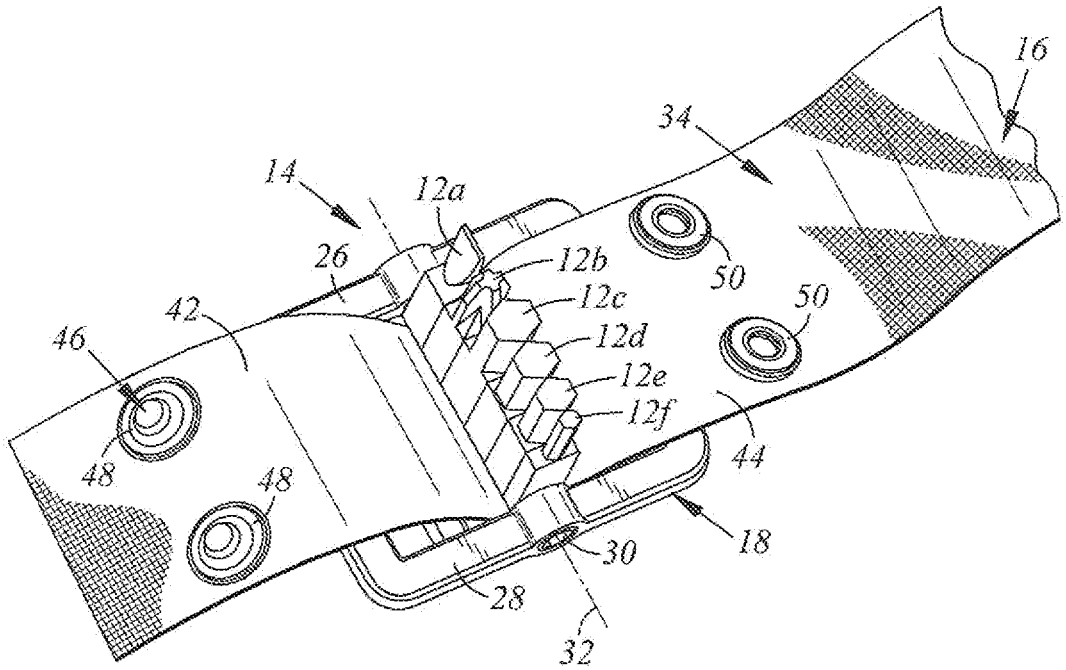
FIG. 4 is an upper perspective view of a belt strap threaded through the fastener, with the belt strap including an end flap segment depicted in an extended configuration leaving the tool bits exposed.
Figure 5:
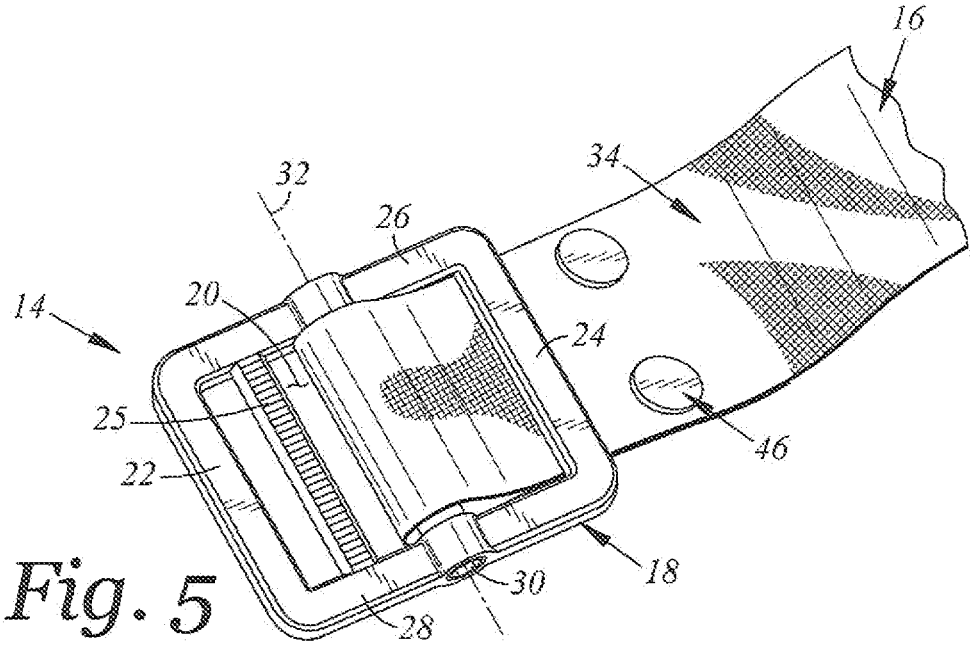
FIG. 5 is an upper perspective view of the belt strap and fastener, with the end flap segment being depicted in a looped configuration so as to conceal the tool bits.

At least one tool bit 12 is pivotally coupled to the cross bar 30 and is pivotable relative to the cross bar 30 about the cross bar axis 32. As shown in FIGS. 1, 3, and 4 the buckle 14 includes six tool bits 12*a-f*. Tool bit 12*a* is a flat-head screw driver bit, tool bit 12*b* is a Philips head screwdriver bit, while tool bits 12*c-f* are different sized Allen-wrench bits, commonly known as hex wrench bits. Other tool bits, such as bottle openers, files, saws, etc., may also be used. Each tool bit 12, as seen in FIG. 1, includes a distal end, a body portion, and a proximate end opposite the distal end having an opening extending therethrough which is sized and configured to receive the cross bar 30 to enable pivotal movement of the tool bit 12 relative to the cross bar 30. The proximate end of the tool bit 12 may be insertable into a hosting tool, such as a screw driver having distal end configured to engage with the tool bits 12.

The tool bits 12*a-f* are pivotal relative to the cross bar 30 between a stowed position, as shown in FIG. 1, and a deployed position. In FIG. 3, tool bit 12*b* is shown in the fully deployed position, while tool bit 12*d* is in a partially deployed position. When the tool bit 12 is in the stowed position, the tool bit 12 is generally co-planar with the buckle frame 18, with the tool bit 12 extending along the longitudinal buckle axis 17 and residing within the buckle plane 15. As the tool bit 12 transitions from the stowed position to the deployed position, the tool bit 12 pivots about the cross bar axis 32 and out of the buckle plane 15 so as to extend generally orthogonal to the buckle plane 15. Although it is contemplated that the tool bit 12 may be removed and inserted into another tool for use, it is also contemplated that the tool bit 12 may remain connected to the frame 18 while the tool bit 12 is used. Along these lines, when the tool bit 12 is in the deployed position and extends generally orthogonal from the frame 18, the user may grip the frame 18 and rotate the frame 18 within the plane 15 to apply a torque on the tool bit 12.

The buckle 14 is adapted for use with a belt strap 16, which is elongate and extends along a longitudinal strap axis. The strap 16 includes a buckle end portion 34 attachable to the buckle 14, and an opposed distal end portion 36 adapted to be selectively threaded through the buckle 14 for securing the belt 10 to the wearer. The belt strap 16 includes an inner surface 38 and an opposing outer surface 40. The belt strap 16 is selectively disposable in an open configuration wherein the distal end portion 36 is disengaged from the buckle 14 and a closed configuration wherein the distal end portion 36 is slidably engaged with the buckle 14. The buckle 14 is coupled to the buckle end portion 34 and configured to frictionally engage the opposed distal end portion 36 such that the strap 16 is held in the closed configuration via friction when worn by the user. The inner surface 38 of the strap 16 faces the wearer when the belt strap 16 is in the closed configuration and is positioned between the tool bits 12 and the outer surface 40 when the belt strap 16 is in the closed configuration to conceal the tool bits 12. The belt strap 16 may be formed of a woven nylon material, leather, or other materials known in the art.

According to one embodiment, the belt strap 16 includes an end flap segment 42 and a body segment 44. The end flap segment 42 is selectively transitional relative to the body segment 44 between a looped configuration and an extended configuration. The end flap segment 42 is shown in the extended configuration in FIG. 4 and in the looped configuration in FIGS. 5-11. The end flap segment 42 may be folded back towards the body segment 44 to overlap a portion of the body segment 44 as the end flap segment 42 transitions from the extended configuration towards the looped configuration. As will be described in more detail below, according to one embodiment, the end flap segment 42 is transitioned from the extended configuration toward the looped configuration to conceal the tool bits 12 and to attach the buckle end portion 34 of the strap 16 to the buckle 14. When the belt strap 16 is in the extended configuration, the buckle 14 may be slidable along the belt strap 16 or removable from the belt strap 16.

A fastener 46 is coupled to the belt strap 16 and is configured to detachably secure the end flap segment 42 in the looped configuration. The exemplary fastener 46 includes complimentary fastener bodies 48, 50 which are engaged with each other when the belt strap 16 is in the looped configuration and disengaged with each other when the belt strap 16 is in the extended configuration. The fastener bodies 48, 50 may include complimentary snap fastener bodies. It is also contemplated that the fastener 46 may include hook and loop fasteners, magnetic fasteners, button-type fasteners, or other fasteners known in the art.

The belt 10 is specifically configured and adapted to capture and completely conceal the tool bits 12 when the belt 12 is worn by the user. In this respect, the tool bits 12 are concealed by being located between the outer surface 40 of the belt 10 and the wearer. It is contemplated that the buckle 14 and corresponding strap 16 may be arranged in a wide range of configurations for concealing the tool bits 12 when the belt 10 is worn. FIG. 6-11 show different ways of configuring the buckle 14 and connecting the strap 16 thereto in a manner which conceals the tool bits 12.

Figure 6:
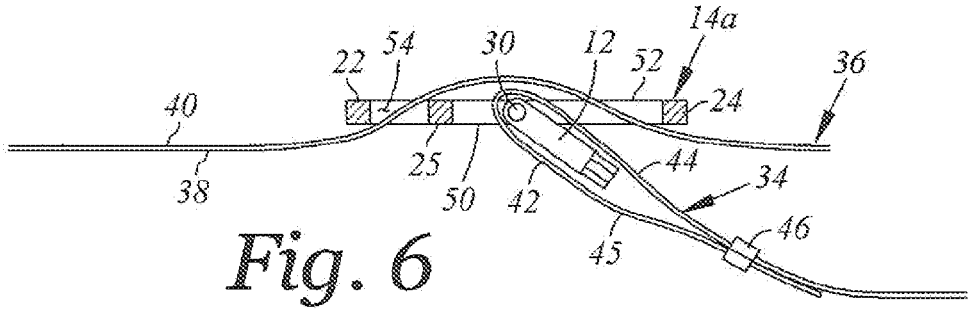
FIGS. 6-11 are side views of different embodiments of the fastener shown with a pair of strap end portions coupled thereto.

Referring first to FIG. 6, there is depicted a buckle 14*a* having an inside face 50 and an opposing outside face 52. The inside face 50 faces toward the wearer when the buckle 14*a* is worn by the wearer, and the outside face 52 faces away from the wearer when the buckle 14*a* is worn by the wearer. The buckle 14*a* is shown with tool bits 12 captured within a loop 45 formed at the buckle end portion 34 of the strap 16. In particular, the end flap segment 42 is looped around the cross bar 30, as well as around the tool bits 12 coupled to the cross bar 30. The end flap segment 42 is then folded back toward the body segment 44 and secured to the body segment 44 via the fastener 46 to form the loop 45, such that the proximate end of each of tool bit 12 that is attached to the cross bar 30 and the proximate end and distal end of each tool bit 12 is captured and entirely concealed in the loop. The distal end portion (e.g., the free end portion) 36 of the strap 16 is threaded through opening 54 defined by frame member 22 and guide bar 25 from the inside face 50 to the outside face 52. The distal end portion 36 then extends over the cross bar 30, and then passes under frame member 24 along the inside face 52 thereof. When the buckle 14*a* is worn by the wearer, the tool bits 12 are concealed within the loop 45 defined by the end flap segment 42 and body segment 44. Furthermore, the distal end portion 36 also passes over the tool bits 12 to provide additional concealment thereof. To access to the tool bits 12, the distal end portion 36 is unthreaded through the buckle in reverse order, and the loop 45 is undone by unfastening the fastener 46.

Figure 7:
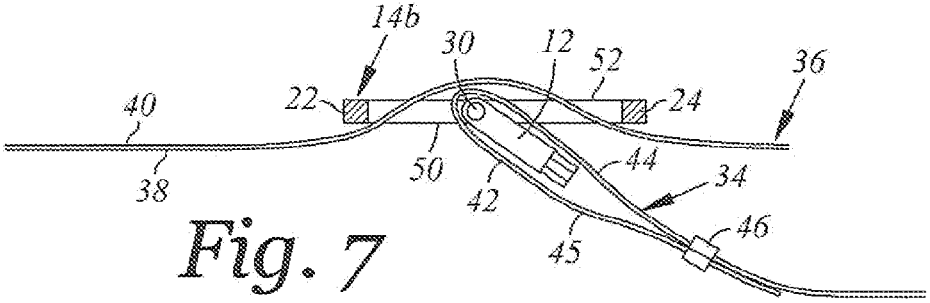

FIG. 7 shows buckle 14*b*, which is a slight modification of the buckle 14*a* depicted in FIG. 6. Buckle 14*b* is similar to buckle 14*a* described above to the extent that buckle 14*b* also includes tool bits 12 captured within a loop 46 defined by the end flap segment 42 and body segment 44 of the belt strap 16. The primary distinction between the buckle 14*b* and the buckle 14*a* is that buckle 14*b* does not include a guide bar 25. As such, when the distal end portion 36 of the strap 16 is fed through the buckle 14*b*, the distal end portion 36 passes directly over the cross bar 30, instead of also passing over the intermediate guide bar 25. As with buckle 14*a*, when the buckle 14*b* is worn by the wearer, the tool bits 12 are concealed within the loop defined by the end flap segment 42 and body segment 44, and the distal end portion 36 also passes over the tool bits 12 to provide additional concealment thereof.

FIGS. 8-11 show additional embodiments wherein the tool bits 12 are not captured within a loop formed at the buckle end portion 34 of the strap 16. Instead, the tool bits 12 are concealed by positioning the tool bits 12 between the wearer and the distal end portion 36 of the strap 16, which results in the tool bits 12 being concealed at least by the distal end portion 36 when the belt 10 is worn by the wearer.

Figure 8:
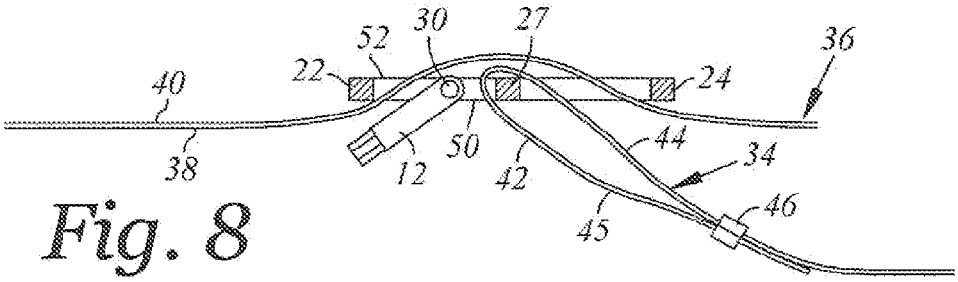

Referring now specifically to FIG. 8, buckle 14*c* is shown defining an inside face 50 and an outside face 52. The buckle 14*c* includes a strap attachment bar 27 around which the buckle end portion 34 of the strap 16 is fastened. In particular, the strap attachment bar 27 may be captured within the loop 45 between end segment 42 and body segment 44. The connection between the end segment 42 and body segment 44 may be more permanent in nature (e.g., sewn) than the connection described above in relation to the embodiments depicted in FIGS. 6 and 7, as there may be no need to undo the loop 45 defined by segments 42, 44. The tool bits 12 are pivotally coupled to the cross bar 30, which may be offset from the midline of the buckle 14*c*. Along these lines, there is no limitation as to where the cross bar 30 or attachment bar 27 may be located on the buckle 14*c*. The distal end portion 36 of the strap 16 is passed from the inside face 50 toward the outside face 52 and around the cross bar 30. The distal end portion 36 extends over the outside face 52 of the attachment bar 27 and then passes under frame member 24 along the inside face thereof. Thus, when the buckle 14*c* is worn, the tool bits 12 are captured between the strap 16 and the wearer. In particular, the inner surface 38 of the strap 16 is positioned between the tool bits 12 and the outer surface 40 of the strap 16. It should be noted that in FIG. 8, the tool bits 12 are not captured between the buckle end portion 34 and distal end portion 36 of the strap 16. Since the cross bar 30 is positioned between frame member 22 and attachment bar 27, and the buckle end portion 34 extends from the attachment bar 27 toward frame member 24, the buckle end portion 34 extends away from the tool bits 12.

Figure 9:
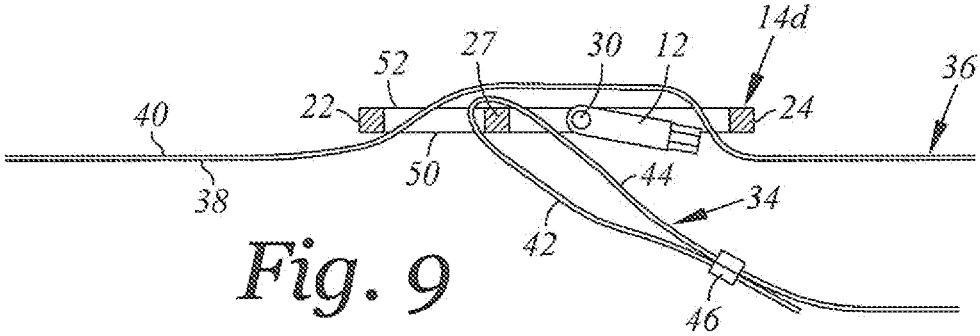

An alternative configuration is shown in FIG. 9, wherein the tool bits 12 are captured between the buckle end portion 34 and the distal end portion 36 when the belt strap 16 is in a closed configuration. In particular, the buckle 14*d* depicted in FIG. 9 includes a cross bar 30 positioned between the attachment bar 27 and the frame member 24. When the belt 10 is in the closed configuration, the buckle end portion 34 of the strap 16 extends from the attachment bar 27 toward frame member 24 and between the tool bits 12 and the wearer. The distal end portion 36 is passed through the buckle 14*d* along the inside face 50 of the frame member 22 and then over the outside face 52 of the attachment bar 27 and over the cross bar 30. The distal end portion 36 then extends under the frame member 24 along the inside face 50 thereof. When the belt 10 including buckle 14*d* is worn by the wearer, the tool bits 12 may capture the distal end portion 36 of the strap 16 to lock the strap in place. In particular, once the distal end portion 36 is woven through the buckle 14*d* as described above, the buckle 14*d* may be pressed against the wearer, which my bring the buckle 14*d* and tool bits 12 into substantially co-planar relation with each other. The tool bits 12 may be sized and configured to pinch or capture the distal end portion 36 between the distal end of the tool bits 12 and the frame member 24.

Figure 10:
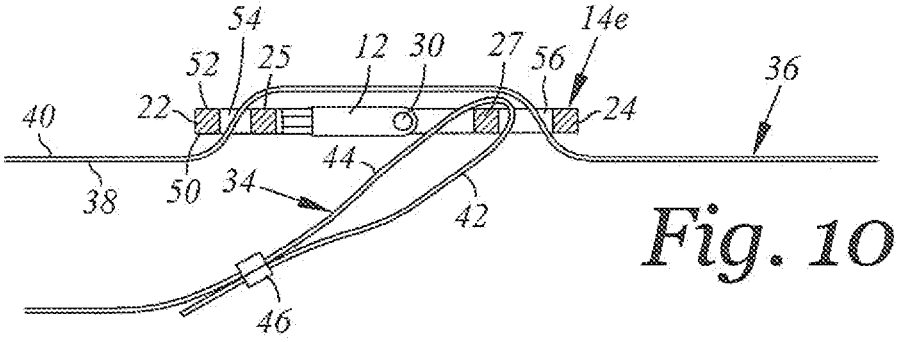

Referring now to FIG. 10, buckle 14*e* is depicted having an attachment bar 27 and a guide bar 25, with the attachment bar 27 being disposed adjacent frame member 24 and the guide bar 25 being disposed adjacent frame member 22. When the buckle 14*e* is worn by the wearer and the belt strap 16 is in the closed configuration, the tool bits 12 are captured between the buckle end portion 34 and the distal end portion 36. In particular, the buckle end portion 34 is coupled to attachment bar 27 and extends toward frame member 22. As such, the buckle end portion 34 passes between the cross bar 30, tool bits 12 and the wearer. The distal end portion 36 is woven through the buckle 14*e* by starting from the inside face 50 and passing through opening 54 defined between the frame member 22 and the guide bar 25. The distal end portion 36 then extends along the outside face 52 over the guide bar 25, the tool bits 12, the cross bar 30 and the attachment bar 27 before passing through opening 56 defined by the attachment bar 27 and frame member 24. The distal end portion 36 passes along the inside face 50 of the frame member 24.

Figure 11:
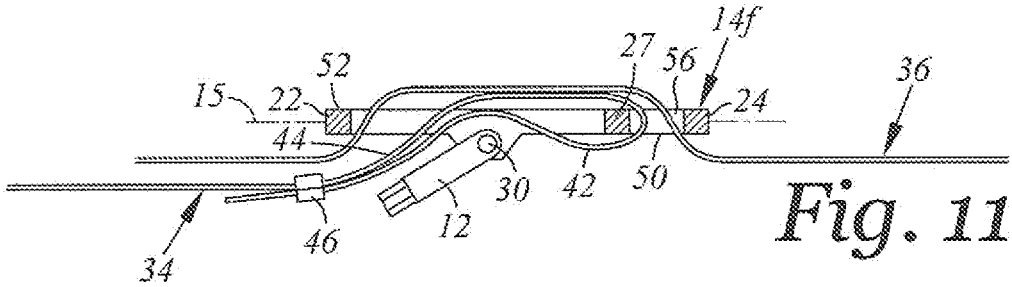

FIG. 11 depicts yet another embodiment of the buckle 14*f* having a cross bar 30 that is slightly offset from the buckle plane 15. This allows the tool bits 12 to be covered by both the buckle end portion 34 and the distal end portion 36. In other words, the tool bits 12 are located between the wearer and the buckle end portion 34, as well as between the wearer and the distal end portion 36 when the belt strap 16 is in the closed configuration. In particular, the buckle end portion 34 is coupled to the attachment bar 27 and extends toward the frame member 22 such that buckle end portion 34 extends along the outside of the belt 10, and the tool bits 12 are located between the buckle end portion 34 and the wearer. The distal end portion 36 is threaded through the buckle 14*f* by starting at the inside face 50 of the frame member 22 and extending along the outside face 52 over the cross bar 30 and the attachment bar 27 before passing through opening 56 and under the frame member 24 along the inside face 50 thereof.

The above-described embodiments include a buckle end portion 34 that is directly connected to a portion of the buckle 14. For instance, the buckle end portion 34 is described as looping around the cross bar 30 or strap attachment bar 27 for attaching the buckle end portion 34 to the buckle 14. However, it is also contemplated that other embodiments may include an intermediate attachment element, such as a hook, which extends between the buckle end portion 34 and the buckle 14 for securing the buckle end portion 34 to the buckle 14. For instance, the hook may be selectively connectable to the cross bar 30, strap attachment bar 27 or other portions of the buckle 14 for connecting the buckle end portion 34 to the buckle 34. The intermediate attachment element is not limited to a hook and may include other mechanical fasteners known by those skilled in the art.

Although the foregoing describes end portions 34, 36 as being opposed ends of a belt strap 16, it is also contemplated that the end portions 34, 36 may be part of separate straps which are joined by the buckle 14. The separate straps may be straps on a bag (e.g., snowboard bag, tool bag, or the like), straps on a camera, or other items which use straps.

The particulars shown herein are by way of example only for purposes of illustrative discussion, and are not presented in the cause of providing what is believed to be most useful and readily understood description of the principles and conceptual aspects of the various embodiments of the present disclosure. In this regard, no attempt is made to show any more detail than is necessary for a fundamental understanding of the different features of the various embodiments, the description taken with the drawings making apparent to those skilled in the art how these may be implemented in practice.

What is claimed is:

1. A multifunctional belt comprising:

an elongate belt strap extending along a longitudinal strap axis, the belt strap having a buckle end portion, an opposed distal end portion and a body segment disposed between the buckle end portion and the opposed distal end portion, the buckle end portion having an end flap segment, the end flap segment being selectively transitional relative to the body segment between a looped configuration and an extended configuration, the end flap segment being folded back towards the body segment to overlap a portion of the body segment as the end flap segment transitions from the extended configuration towards the looped configuration;

a fastener coupled to the belt strap and configured to detachably secure the end flap segment in the looped configuration;

and a buckle coupled to the buckle end portion and configured to frictionally engage the opposed distal end portion, the buckle having:

a buckle frame defining a longitudinal frame axis; a cross bar extending between opposed portions of the buckle frame and defining cross bar axis that is generally perpendicular to the longitudinal frame axis; and at least two tool bits pivotally coupled to the cross bar and pivotable about the cross bar axis, the at least two tools bits includes two screwdriver bits;

wherein the buckle end portion being selectively disposable in an open configuration wherein the distal end portion is disengaged from the buckle, and in a closed configuration wherein the distal end portion is slidably engaged with the buckle and configured to be held in the closed configuration via friction when worn by a user;

wherein each of the at least two tool bits has a proximate end attached to the cross bar and a distal end opposite the proximate end; wherein the proximate end and distal end of each of the at least two tool bits are captured and entirely concealed between the end flap segment and the body segment when the end flap segment is in the looped configuration, and uncovered by the end flap segment as the end flap segment transitions from the looped configuration towards the extended configuration.

2. The multifunctional belt as recited in claim 1, wherein the buckle is slidable along the belt strap when the belt strap is in the extended configuration.

3. The multifunctional belt as recited in claim 1, wherein the buckle is removable from the belt strap when the belt strap is in the extended configuration.

4. The multifunctional belt as recited in claim 1, wherein the at least two tool bits are screwdriver bits selected from a group consisting of a Philips head bit, a flat-head bit, and a hex wrench bit.

5. The multifunctional belt as recited in claim 1, wherein the fastener includes complimentary fastener bodies which are engaged with each other when the belt strap is in the looped configuration and disengaged with each other when the belt strap is in the extended configuration.

6. The multifunctional belt as recited in claim 5, wherein the fastener bodies include complimentary snap fastener bodies.

7. The multifunctional belt as recited in claim 1, wherein the buckle frame includes a quadrangular frame member and the cross bar extends between opposed portions of the quadrangular frame member.

8. The multifunctional belt as recited in claim 1, wherein the distal end portion is formed of a continuous smooth material.

* * * * *